US006795987B2

(12) United States Patent
Cornwall

(10) Patent No.: US 6,795,987 B2
(45) Date of Patent: Sep. 28, 2004

(54) TRAP GUARD DEVICE

(76) Inventor: Kenneth R. Cornwall, 1020 Vintage Club Dr., Duluth, GA (US) 30097

( * ) Notice: Subject to any disclaimer, the term of this patent is extended or adjusted under 35 U.S.C. 154(b) by 112 days.

(21) Appl. No.: 10/245,126

(22) Filed: Sep. 17, 2002

(65) Prior Publication Data

US 2004/0049846 A1 Mar. 18, 2004

(51) Int. Cl.[7] ..... E03C 1/12
(52) U.S. Cl. ..... 4/679; 4/287
(58) Field of Search ..... 4/679, 425, 426, 4/423, 682, 287; 137/362, 849, 846, 850, 843, 844; 220/86.2

(56) References Cited

U.S. PATENT DOCUMENTS

| | | | | | |
|---|---|---|---|---|---|
| 194,329 | A | | 8/1877 | Buhrer | |
| 220,559 | A | | 10/1879 | Wilson | |
| 803,979 | A | | 11/1905 | Bonnell | |
| 2,328,382 | A | | 8/1943 | Langdon | |
| 2,352,642 | A | | 7/1944 | Langdon | |
| 2,371,449 | A | | 3/1945 | Langdon | |
| 2,382,427 | A | | 8/1945 | Langdon | |
| 2,594,318 | A | | 4/1952 | Langdon | |
| 2,598,002 | A | * | 5/1952 | Langdon | 137/846 |
| 3,118,468 | A | | 1/1964 | Bochen | |
| 3,565,106 | A | * | 2/1971 | William | 137/847 |
| 3,707,986 | A | | 1/1973 | Breen | |
| 4,098,287 | A | * | 7/1978 | Baumbach | 137/849 |
| 4,289,166 | A | | 9/1981 | Haines | |
| 4,501,374 | A | * | 2/1985 | Robertson | 220/86.2 |
| 4,524,805 | A | | 6/1985 | Hoffman | |
| 4,828,554 | A | * | 5/1989 | Griffin | 137/846 |
| 4,870,992 | A | | 10/1989 | Irwin et al. | |
| 5,551,483 | A | | 9/1996 | Hochstrasser | |
| 5,727,593 | A | * | 3/1998 | Duer | 137/846 |
| 5,881,772 | A | | 3/1999 | Bennett | |
| 6,092,551 | A | | 7/2000 | Bennett | |

* cited by examiner

*Primary Examiner*—Gregory L. Huson
*Assistant Examiner*—Khoa Huynh
(74) *Attorney, Agent, or Firm*—Mary M. Moyne; Ian C. McLeod

(57) ABSTRACT

A valve for use in a floor drain to prevent the backflow of fluids from the drain system. The valve includes a valve member and a collar. The first end of the valve member is mounted to the outer surface of the second portion of the collar. In the normal position, the sidewall of the valve member at the second end of the valve member is curled and the valve is in the closed position. When a preset amount of fluid pressure is provided through the collar to the first end of the valve member, the sidewall of the valve member flexes to an open position forming an inner passageway between the ends of the valve member.

9 Claims, 5 Drawing Sheets

TRAP GUARD DEVICE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION (1) Field of the Invention

The present invention relates to a valve for use in a floor drain connected to a drain system to prevent gases from escaping from the drain system. In particular, the present invention relates to a valve for use in a floor drain which has a flexible valve member.

(2) Description of the Related Art

The related art has shown various trap valves which have a flexible sidewall which is normally in the closed position to prevent the backflow of fluids. Illustrative are U.S. Pat. No. 803,979 to Bonnell; U.S. Pat. No. 3,707,986 to Breen and U.S. Pat. No. 4,870,992 to Irwin et al.

Bonnell describes a seal trap for the drain pipe of sinks which prevents the backflow of noxious odors, gases, and water from such pipes. The seal device is inserted into a hollow tubular casing which is mounted in the drain pipe of the sink. The seal device is constructed of flexible material which possesses elastic qualities and is impervious to water and other liquids.

Breen describes a diaphragm valve for mounting in the drain line of a sink. The device is constructed of a tubular resilient member having a transverse seat at the upper end for securing the device in the drain. Below the seat is a cylindrical section and a conical section from which depends three (3) axially extending and radially orientated flanges. The valve prevents the back up of water and gases through the drain of a sink.

Irwin et al describes a backflow prevention device adapted to be installed in the drain opening of fluid conduits. The device includes a drain insert member connected to the fluid conduit adjacent the inlet opening. A valve member is positioned in the insert member adjacent the inlet opening of the fluid conduit. The valve member includes a substantially rigid, annular shaped portion and a deformable wall connected thereto and extending outwardly therefrom. The annular portion is clamped between the edge of the insert member and the inlet of the waste line. The deformable wall has a first portion in close engagement with the fluid conduit and a second portion. The second portion is normally disposed in engagement with the first portion. The second portion deforms in response to fluid pressure, from a closed position to an open position. In the open position, the valve member provides a wide open passageway to accommodate the free flow of fluids through the valve and into the conduit. When the valve member is in the closed position, the flow of fluids in the opposite direction is prevented. This invention is limited with regard to the size of the conduit due to the fact that the valve member rests adjacent a side of the fluid conduit.

Also of interest are U.S. Pat. Nos. 2,328,382; 2,352,642; 2,371,449; 2,382,427; 2,594,318 and 2,598,002 all to Langdon which show various types of flexible check valves, some of which also are for use in vacuums or siphon breaking devices.

Only of minimal interest are U.S. Pat. No. 194,329 to Buhrer and U.S. Pat. No. 220,559 to Wilson.

Buhrer describes a stench trap for sinks. The trap includes a flexible valve. In this invention, the casing for the valve provides an inclined seat for the valve upon which the valve rests.

Wilson shows a gas check valve having a pliable section which is mounted in a chamber filled with water. The pressure of the water in the chamber causes the pliable section to close tightly and make a gas-tight joint.

Of some interest are U.S. Pat. No. 4,524,805 to Hoffman; U.S. Pat. No. 5,551,483 to Hochstrasser; U.S. Pat. No. 5,881,772 to Bennett; U.S. Pat. No. 6,092,551 Bennett and U.S. Pat. No. 4,289,166 to Haines which show elastomeric valves and U.S. Pat. No. 3,118,468 to Bochan which describes a resilient member check valve.

There remains the need for a valve for inserting into the floor drain of a drain system which has a flexible sidewall which curls at one end to prevent backflow of fluids through the valve into the floor drain.

SUMMARY OF THE INVENTION

A valve for use in a floor drain to prevent the backflow of fluids such as sewer gases from the drain system and sewer system. The valve includes a valve member and a collar. The first portion of the collar has an outer diameter slightly less than the diameter of the center bore of the drain insert of the floor drain. A seal can be provided around the outer surface of the collar to form a seal between the outer surface of the collar and the center bore of the drain insert. The valve member has a first end and a second end with a flexible sidewall extending therebetween. The first end of the valve member is mounted to the outer surface of the second portion of the collar. In the normal position, the second end of the valve member is curled away from the longitudinal axis of the valve and the valve is in the closed position. The curled second end of the valve member helps to prevent fluids from entering the valve through the second end of the valve member. When a preset amount of fluid pressure is provided through the collar to the first end of the valve member, the sidewall flexes to an open position forming a complete inner passageway between the ends of the valve member. The first end of the collar can be provided with tabs in the inner passageway which allow for easy removal of the valve from the floor drain. The valve can be positioned in a floor drain having a drain insert and a strainer top. The valve could also be positioned in a hub drain having a pipe which extends above the floor and which has an open top end.

The present invention relates to a valve for use in a floor drain connected to a drain system to prevent gases from escaping from the drain system through the floor drain which comprises: a collar having a first end and a second end with an inner passageway extending between the ends; and a valve member having a first end and a second end with a flexible sidewall extending between the ends and forming an inner passageway, wherein the first end of the valve member is connected to the second end of the collar wherein in a normal position, the inner passageway of the valve member tapers in cross-section from the first end toward the second end of the valve member and the flexible sidewall adjacent the second end of the valve member is curled and wherein when fluid is introduced into the inner passageway of the valve member at the first end of the valve member, the flexible sidewall uncurls and the inner passageway of the valve member expands adjacent the second end such as to allow fluid to exit the valve member through the second end of the valve member.

Further, the present invention relates to a floor drain for use in a drain system and having a drain insert with a center bore and a strainer top for mounting on one end of the drain insert, the improvement which comprises: a valve mounted in the center bore of the floor drain to prevent fluids in the drain system from escaping the drain system through the floor drain, the valve including: a collar having a first end and a second end with an inner passageway extending between the ends; and a valve member having a first end and a second end with a flexible sidewall extending between the ends and forming an inner passageway, wherein the first end of the valve member is connected to the second end of the collar, wherein in a normal position, the inner passageway of the valve member tapers in cross-section from the first end toward the second end of the valve member and the flexible sidewall adjacent the second end of the valve member is curled and wherein when fluid is introduced into the inner passageway of the valve member at the first end, the flexible sidewall uncurls and the inner passageway of the valve member expands adjacent the second end such as to allow fluid to exit the valve member through the second end of the valve member.

Still further, the present invention relates to a valve for use in a floor drain connected to a drain system to prevent gases from escaping from the drain system through the floor drain which comprises: a collar having a first end and a second end with an inner passageway extending between the ends and forming a longitudinal axis of the collar; and a valve member having a first end and a second end with a flexible sidewall extending between the ends and forming an inner passageway, wherein the first end of the valve member is connected to the second end of the collar, wherein in a normal position, the inner passageway of the valve member tapers in cross-section from the first end of the valve member to the second end of the valve member and the flexible sidewall adjacent the second end is curled away from the longitudinal axis of the collar and wherein when fluid is introduced into the inner passageway of the valve member at the first end, the flexible sidewall uncurls and the inner passageway of the valve member expands adjacent the second end such that the valve is in the open position and allows the fluid to exit through the second end of the valve member.

Further still, the present invention relates to a method for preventing gases in a drain system from escaping through an entrance of the drain system while allowing fluids to enter the drain system through the entrance, which comprises the steps of: providing a floor drain having a drain insert with a center bore and having a strainer top; providing a valve including a collar having a first end and a second end with an inner passageway extending between the ends; and a valve member having a first end and a second end with a flexible sidewall extending between the ends of the valve member and forming an inner passageway of the valve member, wherein the first end of the valve member is connected to the second end of the collar wherein in a normal position, the inner passageway of the valve member tapers in cross-section from the first end to the second end of the valve member and the flexible sidewall adjacent the second end is curled; connecting the floor drain to the drain system; positioning the valve in the center bore of the drain insert of the floor drain such that the valve member extends through the center bore of the floor drain and into the drain system wherein the collar of the valve forms a seal with the center bore of the drain insert; and positioning the strainer top on one end of the drain insert of the floor drain opposite the valve member such as to enclose the valve in the drain insert wherein in the normal position, the second end of the valve member is closed and prevents gases from exiting the drain system through the floor drain and wherein when fluid is inserted into the inner passageway of the valve member at the first end of the valve member, the flexible sidewall uncurls and the inner passageway of the valve member expands adjacent the second end of the valve member such as to allow fluid to exit the valve member at the second end and enter the drain system.

The substance and advantages of the present invention will become increasingly apparent by reference to the following drawings and the description.

BRIEF DESCRIPTION OF THE DRAWING(S)

FIG. 1 is a cross-sectional view of the valve 10 positioned in a floor drain 100 showing the valve 10 in the normal closed position with the drain shown in the open position in phantom.

DESCRIPTION OF THE PREFERRED EMBODIMENT(S)

Figure 1:
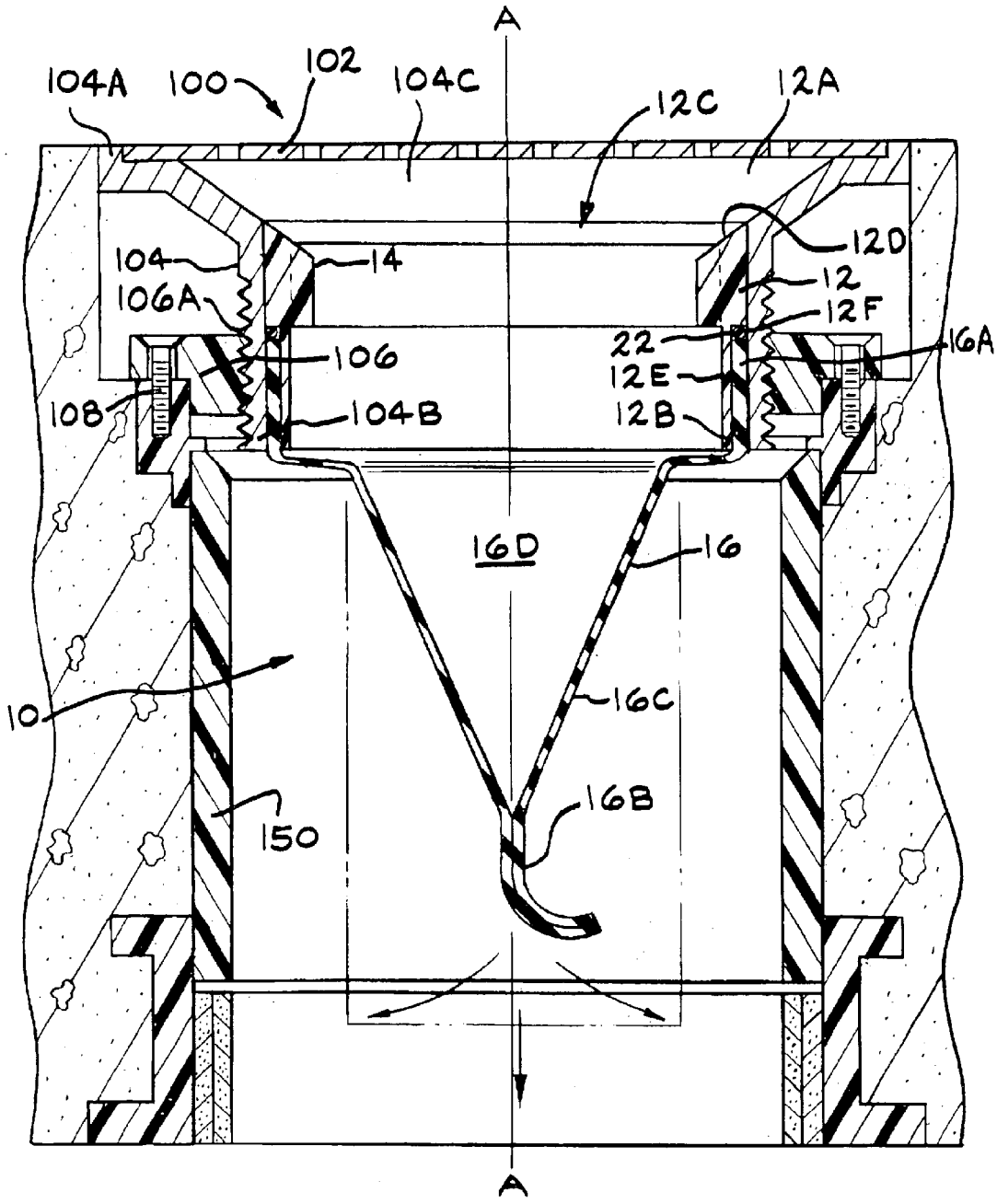

The present invention relates to a valve 10 for use in a floor drain 100 or 110 to prevent fluids such as sewer gases from escaping from the drain system 150 or sewer system through the floor drain 100 or 110. In one (1) embodiment, the floor drain 100 is similar to standard floor drains well known in the art. The floor drain 100 includes a strainer top or grate 102, a drain insert 104 and a mounting flange 106. The mounting flange 106 is configured to mount or be secured to the entrance of the drain system 150 (FIG. 1). The mounting flange 106 can be secured to the drain system 150 by any well known means such as fasteners 108. The mounting flange 106 has a center opening 106A into which is mounted the drain insert 104. The drain insert 104 has a first end 104A and a second end 104B with a center bore 104C extending therebetween. The center bore 104C of the drain insert 104 has a first portion adjacent the first end 104A and a second portion adjacent the second end 104B. The first portion of the center bore 104C at the first end 104A of the drain insert 104 is tapered to direct the flow of fluids toward the center bore 104C. In one (1) embodiment, the second portion of the drain insert 104 adjacent the second end 104B of the drain insert 104 is cylindrical. The outer surface of the second portion of the drain insert 104 can be provided with threads which engage threads on the center opening 106A of the mounting flange 106 such that the drain insert 104 is threadably mounted in the center opening 106A of the mounting flange 106. The strainer top 102 is provided for removably securing over the opening of the center bore 104C at the first end 104A of the drain insert 104.

Figure 6:
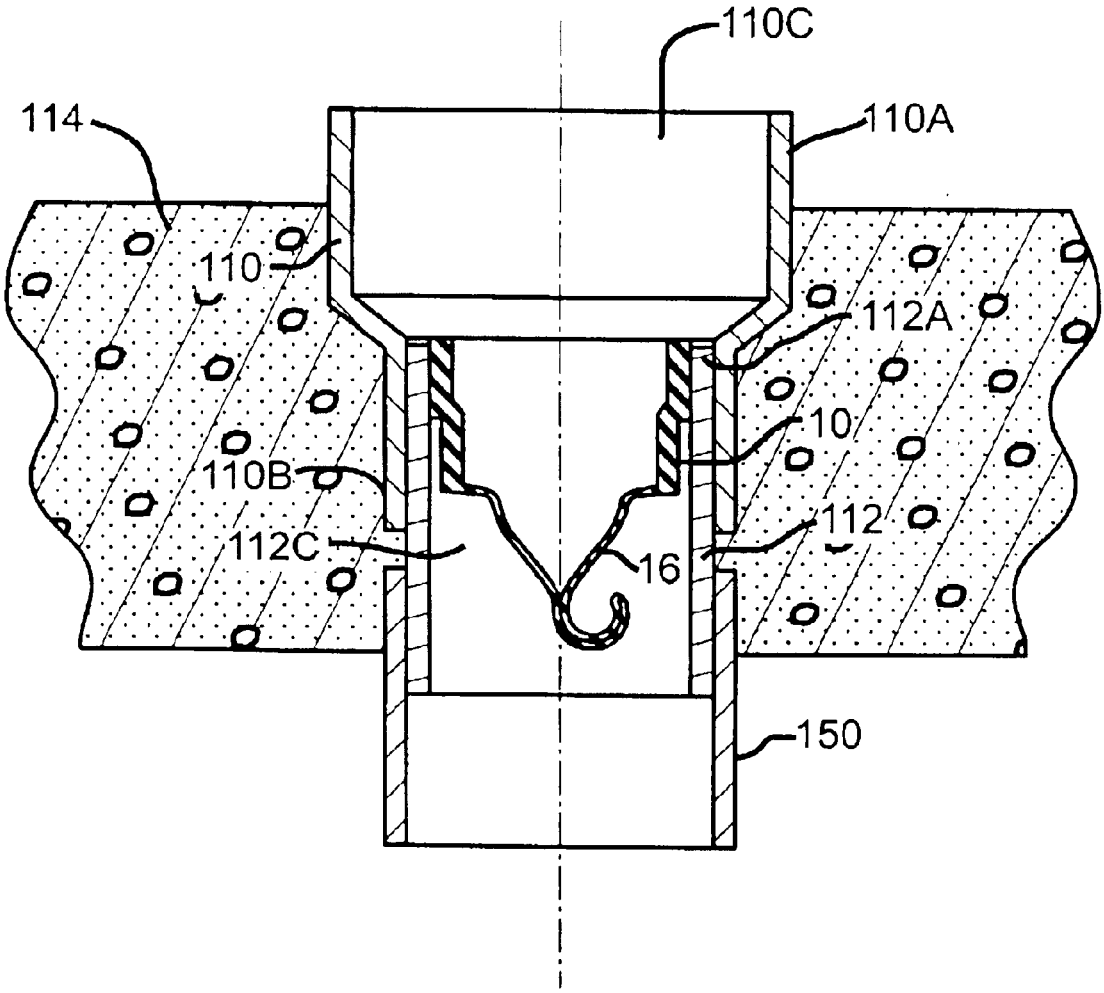
FIG. 6 is a cross-sectional view showing the valve 10 positioned in a hub drain.

In another embodiment, the floor drain is a hub drain 110 having an open first end 110A and a second end 110B with a center bore 110C extending therebetween (FIG. 6). The first end 110A of the hub drain 110 extends above the floor 114 in which it is mounted. The second end 110B of the hub drain 110 is connected by an inner connector pipe 112 to the drain system 150. The first section of the center bore 110C at the first end 110A of the hub drain 110 is enlarged to enable liquid to flow into the drain system 150. The center bore 110C tapers to a second section adjacent the second end 110B. The connector pipe 112 extends upward in the center bore 110C such that the open first end 112A of the connector pipe 112 is flush with the op of the second section of the adjacent tapered section of the center bore 110C.

Figure 2:
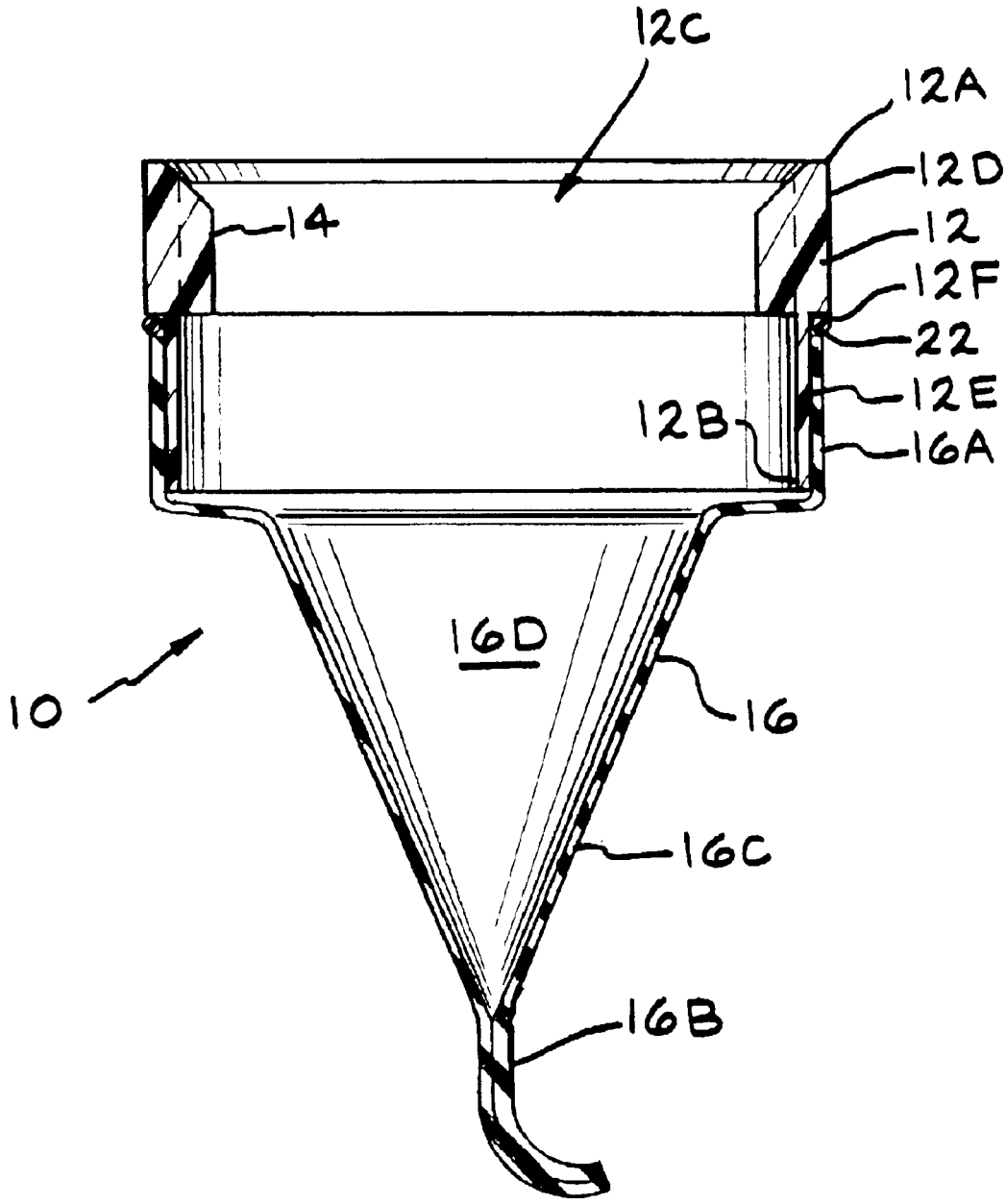
FIG. 2 is a cross-sectional view of the valve 10.
Figure 3:
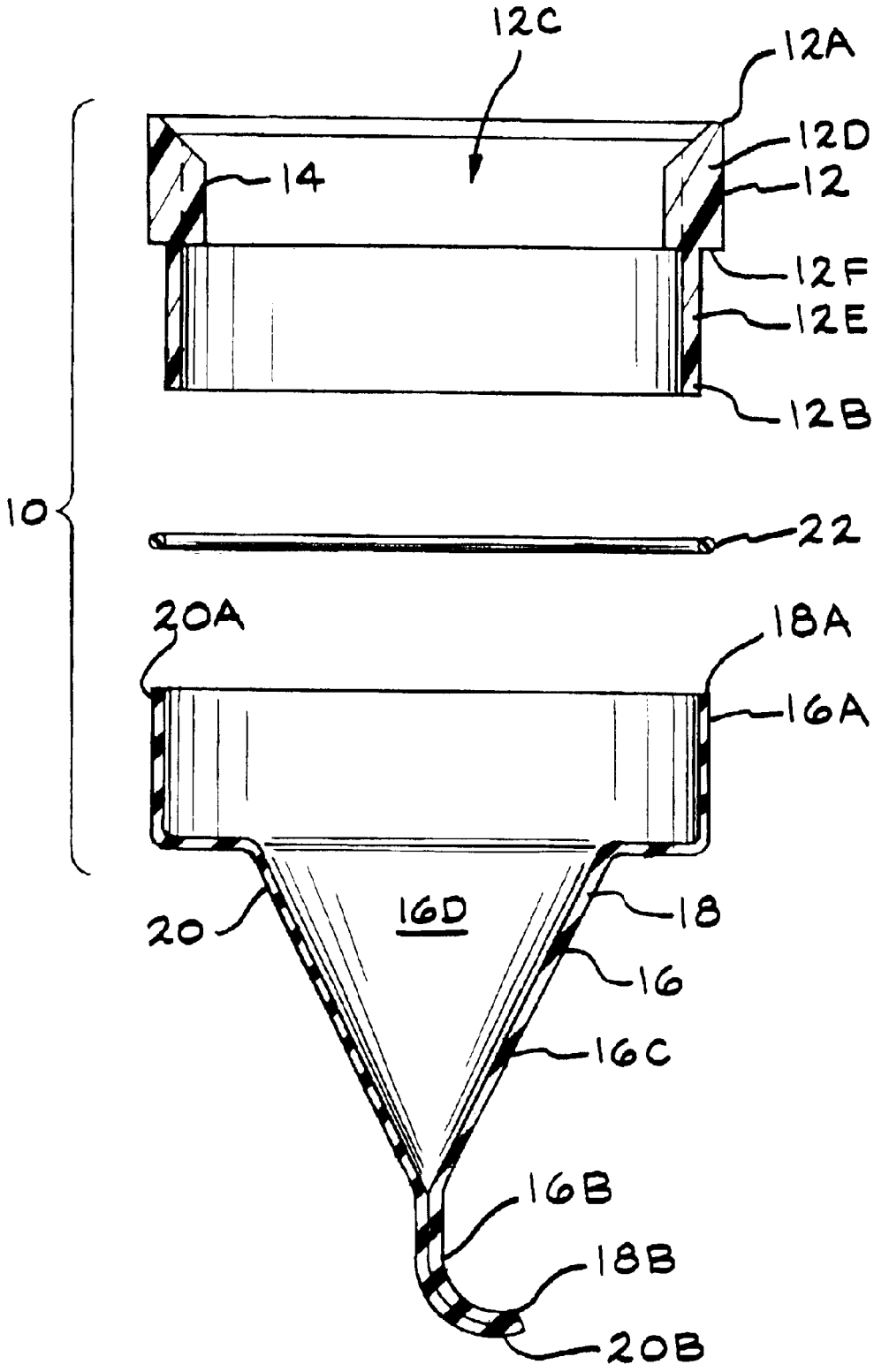
FIG. 3 is an exploded, cross-sectional view of the valve 10.
Figure 4:
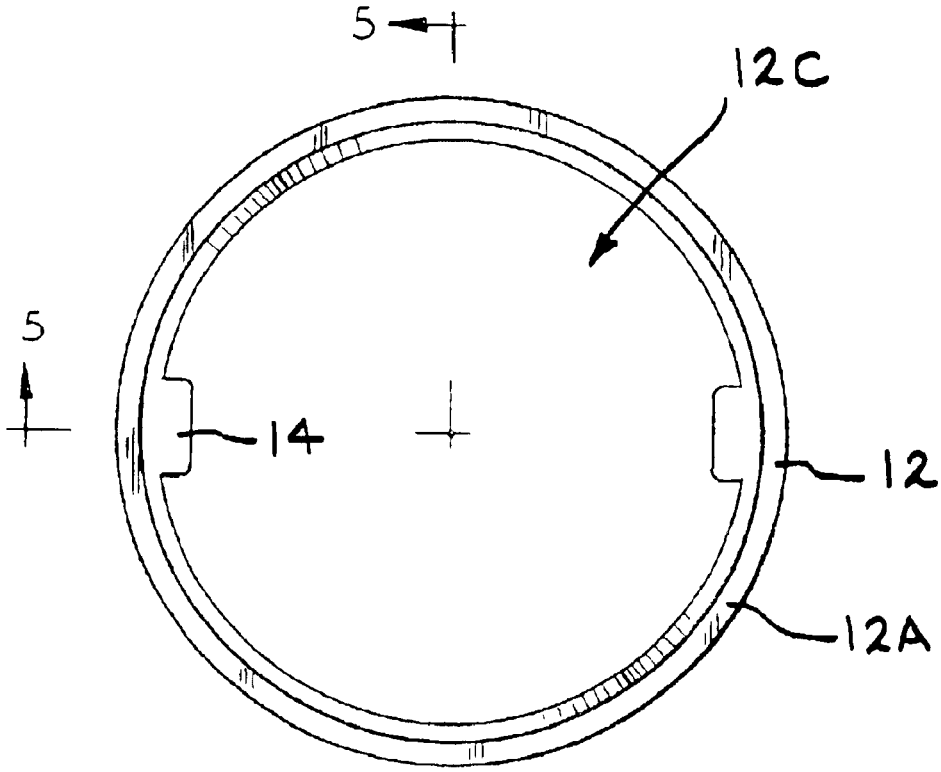
FIG. 4 is a top view of the valve 10.
Figure 5:
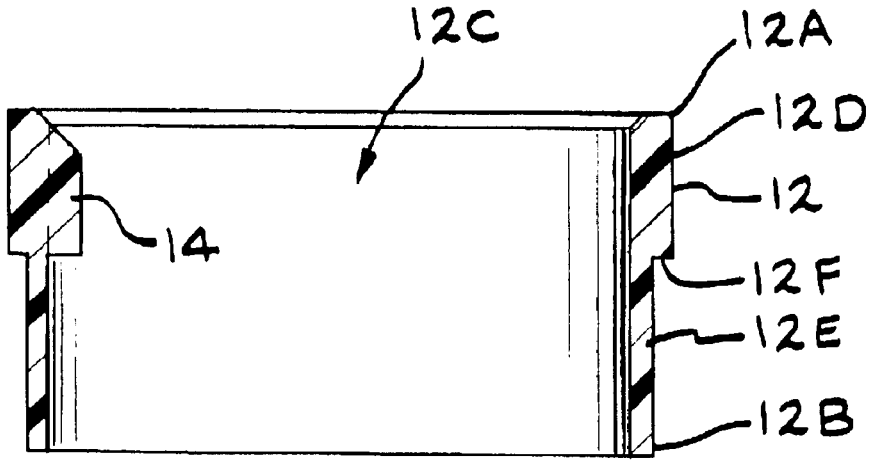
FIG. 5 is a cross-sectional view along line 5—5 of FIG. 4 showing the collar 12.

The valve 10 includes a collar 12 and a valve member 16 connected to the collar 12 (FIGS. 2 and 3). The collar 12 has a first end 12A and a second end 12B with an inner passageway 12C extending between the ends 12A and 12B. In one (1) embodiment, the diameter of the inner passageway 12C of the collar 12 is essentially constant between the ends 12A and 12B. The axis of the inner passageway 12C of the collar 12 forms the longitudinal axis A—A of the valve 10 (FIG. 1). In one (1) embodiment, the collar 12 has a cylindrical shape. The collar 12 has a first portion 12D adjacent the first end 12A and a second portion 12E adjacent the second end 12B. The outer diameter of the first portion 12D is greater than the outer diameter of the second portion 12E such that a shoulder 12F is formed on the outer surface of the collar 12 between the first and second portions 12D and 12E. In one (1) embodiment, the outer diameter of the first portion 12D of the collar 12 is essentially equal to the diameter of the center bore 104C of the drain insert 104 such that the collar 12 can be positioned in the center bore 104C of the drain insert 104. The inner passageway 12C adjacent the first end 12A of the collar 12 can be provided with tabs 14 which are spaced apart around the circumference of the inner passageway 12C and which extend inward toward the center of the inner passageway 12C (FIGS. 4 and 5).

The valve member 16 has a first end 16A and a second end 16B with a flexible sidewall 16C extending therebetween and forming an inner passageway 16D. The first end 16A is mounted on the second portion 12E of the collar 12 such that the second portion 12E of the collar 12 is in the inner passageway 16D of the valve member 16 and the inner passageway 12C at the first end 12A is coaxial with the longitudinal axis A—A of the valve 10. The flexible sidewall 16C is of such a size that the first end 16A of the sidewall 16C can be stretched to mount over the second portion 12E of the collar 12. The valve member 16 can be constructed of a durable, flexible resilient material having memory. In one (1) embodiment wherein the sidewall is constructed of a material having memory, the memory of the flexible sidewall 16C flexes the sidewall 16C inward and holds the sidewall 16C in place on the collar 12 by friction. The first end 16A of the valve member 16 can be mounted to the collar 12 by any well known means such as by friction fit or by use of an adhesive. In one (1) embodiment, the flexible sidewall 16C is constructed of a first panel 18 and a second panel 20. Each panel 18 or 20 has a rectangular shape with a first end 18A or 20A and a second end 18B or 20B with sides (not shown) extending therebetween. To form the sidewall 16C, the panels 18 and 20 are connected together along the sides with the first end 18A of the first panel 18 adjacent the first end 20A of the second panel 20. When the panels 18 and 20 are connected together to form the sidewall 16C, the panels 18 and 20 are not connected together at either end. The second end 16B of the valve member 16 is curled away from the axis A—A of the valve 10. In one (1) embodiment, the second end 16B of the valve member 16 is curled by heating the sidewall 16C and curling the sidewall 16C using a heated, cylindrical rod. In one (1) embodiment, the second end 16B of the valve member 16 has a J-shape. In the normal position, in one (1) embodiment, where the flexible sidewall 16C is constructed of panels 18 and 20, the panels 18 and 20 are essentially parallel to each other at the second end 18B or 20B. In one (1) embodiment, the valve member 16 is constructed of a specifically formulated elastomeric flexible PVC material such as SUNPRENE™ which will remain flat and which has memory. An o-ring or seal 22 can be provided between the first end 16A of the valve member 16 and shoulder 12F on the outer surface of the collar 12 (FIGS. 2 and 3). The seal 22 can be constructed as part of the valve member 16. In one (1) embodiment, the outer diameter of the first portion 12D of the collar 12 is greater than the outer diameter of the second portion 12E of the collar 12 with the valve member 16 attached. In one (1) embodiment, the seal 22 has an outer diameter greater than the diameter of the first portion 12D of the collar 12.

The valve 10 of the present invention is intended to be used in a floor drain 100 or 110 connected to a building drain system 150. However, it is understood that the valve 10 could be used in any drain where it is desirable to prevent fluids from exiting the drain system 150 or sewer system through the drain. The valve 10 can be positioned in the floor drain 100 or 110 before or after the floor drain 100 or 110 is mounted in position in the building. In the embodiment having the floor drain 100 with a drain insert 104, the valve 10 is inserted into the center bore 104C of the drain insert 104. First, the second end 16B of the valve member 16 is inserted into the center bore 104C of the drain insert 104. The valve 10 is inserted until the second portion 12E of the collar 12 is fully within the center bore 104C and the seal 22 contacts the sides of the center bore 104C. The valve 10 is inserted into the center bore 104C of the drain insert 104 such that the first end 12A of the collar 12 does not extend beyond the first end 104A of the drain insert 104. In one (1) embodiment, the collar 12 of the valve 10 is completely within the cylindrical, second portion of the center bore 104C of the drain insert 104. In one (1) embodiment, the first end 12A of the collar 12 of the valve 10 is spaced slightly below the strainer top 102. Once the valve 10 is in position in the drain insert 104, the strainer top 102 is placed on the drain insert 104. The strainer top 102 prevents the valve 10 from moving upward out of the drain insert 104. In another embodiment, where the floor drain is a hub drain 110, the valve 10 is positioned in the center bore 112C of the connector pipe 112 at the open top 112A such that liquid enters the open first end 110A of the hub drain 110 and flows along the tapered section of the center bore 110C into the open first end 12C of the collar 12 (FIG. 6). In one (1) embodiment, the valve 10 is held in place by a friction fit between the seal 22 and the inner surface of the center bore 104C of the drain insert 104 or the inner surface of the center bore 112C of the connector pipe 112. The seal 22 also provides a fluid tight seal between the center bore 104C or 112C and the collar 12 of the valve 10. In another embodiment, an adhesive or caulk (not shown) is provided between the outer surface of the collar 12 and the inner surface of the center bore 104C or 112C.

In the normal position, the second end 16B of the valve member 16 is in the closed position. In this position, no fluids from the drain system 150 or other plumbing or sewer system are able to enter the valve member 16 through the second end 16B. Thus, the valve 10 with the valve member 16 in the closed position prevents fluids, such as for example sewer gases, from exiting the drain system 150 or plumbing or sewer system through the drain. When fluids flow into the floor drain 100 or 110 and into the center bore 104C or 112C of the drain insert 104 or connector pipe 112, the fluids enter the inner passageway 12C of the collar 12 and flow into the inner passageway 16D of the valve member 16 and into contact with the flexible sidewall 16C of the valve member 16. When the pressure of the fluid in the inner passageway 12C of the collar 12 reaches a predetermined amount, the flexible sidewall 16C flexes or moves and the valve 10 opens. As the valve 10 opens, the second end 16B of the valve member 16 uncurls and the flexible sidewall 16C of the valve member 16 moves to expand the size of the inner passageway 16D to the second end 16B of the valve member 16 and open the second end 16B of the valve member 16. In one (1) embodiment, the pressure of the fluid causes the diameter of the inner passageway 16D of the valve member 16 between the second end 12B of the collar 12 and the second end 16B of the valve member 16 to be essentially equal to the diameter of the inner passageway 12C of the collar 12. In one (1) embodiment, when the valve 10 is in the fully, open position, the longitudinal axis of the inner passageway 16D of the valve member 16 is coaxial with the longitudinal axis A—A of the valve 10 and the longitudinal axis of the collar 12 (FIG. 1). In the one (1) embodiment where the sidewall 16C is formed by panels 18 and 20, the fluid pressure forces the panels 18 and 20 apart to form the inner passageway 16D. The valve 10 continues to remain open as long as the fluid pressure is present. When the fluid is reduced or removed and the fluid pressure is reduced below the predetermined amount, the second end 16B of the valve member 16 closes and returns to the normal, curled position. The curling of the second end 16B of the flexible valve member 16 assists in preventing the fluids from entering the inner passageway 16D of the valve member 16 through the second end 16B of the valve member 16. To remove the valve 10 from the floor drain 100 or 110, a removal tool (not shown) is positioned on the tabs 14 and the valve 10 is pulled upward out of the floor drain 100 or 110. This allows the valve 10 to be replaced without having to remove the floor drain 100 or 110.

It is intended that the foregoing description be only illustrative of the present invention and that the present invention be limited only by the hereinafter appended claims.

I claim:

1. A floor drain used in a drain system, the floor drain having a drain insert with a center bore and a strainer top for mounting on one end of the drain insert, the improvement which comprises:

a valve mounted in the center bore of the floor drain to prevent fluids in the drain system from escaping the drain system through the floor drain, the valve including:

(a) a collar having a first end and a second end with an inner passageway extending between the ends and having a first portion and a second portion, wherein an outer diameter of the first portion is greater than an outer diameter of the second portion;

(b) a valve member having a first end and a second end with a flexible sidewall extending between the ends and forming an inner passageway, wherein the first end of the valve member is mounted over the second portion of the collar; and (c) an o-ring positioned between the first end of the valve member and the first portion of the collar, wherein an outer diameter of the o-ring is slightly greater than a diameter of the center bore of the drain insert such that the o-ring forms a seal between the center bore of the drain insert and the collar, wherein in a normal position, the inner passageway of the valve member tapers in cross-section from the first end toward the second end of the valve member and the flexible sidewall adjacent the second end of the valve member is curled and wherein when fluid is introduced into the inner passageway of the valve member at the first end, the flexible sidewall uncurls and the inner passageway of the valve member expands adjacent the second end such as to allow fluid to exit the valve member through the second end of the valve member.

2. The floor drain of claim 1 wherein the collar of the valve has a shape and size such as to closely fit within the center bore of the drain insert.

3. The floor drain of claim 2 wherein a portion of the collar is cylindrical and wherein the center bore of the drain insert is cylindrical and wherein an outer diameter of the portion of the collar is slightly less than a diameter of the center bore of the drain insert.

4. The floor drain of claim 3 wherein the collar has a first portion and a second portion and wherein the valve member is mounted on the second portion of the collar and wherein an outer diameter of the first portion of the collar and an outer diameter of the second portion of the collar with the valve member attached is slightly less than the diameter of the center bore of the drain insert.

5. The floor drain of claim 1 wherein the center bore of the drain insert has a first portion adjacent a first end of the drain insert and a second portion adjacent the second end, wherein the second portion has a cylindrical shape with a constant diameter and wherein the collar is positioned completely within the second portion of the center bore of the drain insert.

6. The floor drain of claim 1 wherein the flexible sidewall of the valve member at the second end has a J-shape.

7. The floor drain of claim 1 wherein the valve member is constructed of a resilient material having a memory such that when the fluid is removed from the inner passageway of the valve member, the valve member returns to the normal position with the flexible sidewall curled at the second end of the valve member.

8. The floor drain of claim 1 wherein in the normal position, the second end of the valve member is closed to prevent the fluids in the drain system from entering the inner passageway of the valve member through the second end of the valve member.

9. A method for preventing gases in a drain system from escaping through an entrance of the drain system while allowing fluids to enter the drain system through the entrance, which comprises the steps of:

(a) providing a floor drain having a drain insert with a center bore and having a strainer top;

(b) providing a valve including a collar having a first end and a second end with an inner passageway extending between the ends and having a first portion and a second portion, wherein an outer diameter of the first portion is greater than an outer diameter of the second portion; and a valve member having a first end and a second end with a flexible sidewall extending between the ends of the valve member and forming an inner passageway of the valve member, wherein the first end of the valve member is mounted over the second portion of the collar, an o-ring positioned between the first end of the valve member and the first portion of the collar, wherein an outer diameter of the o-ring is slightly greater than a diameter of the center bore of the drain insert such that the o-ring forms a seal between the center bore of the drain insert and the collar; wherein in a normal position, the inner passageway of the valve member tapers in cross-section from the first end to the second end of the valve member and the flexible sidewall adjacent the second end is curled;

(c) connecting the floor drain to the drain system;

(d) positioning the valve in the center bore of the drain insert of the floor drain such that the valve member extends through the center bore of the floor drain and into the drain system wherein the collar of the valve forms a seal with the center bore of the drain insert; and (e) positioning the strainer top on one end of the drain insert of the floor drain opposite the valve member such as to enclose the valve in the drain insert wherein in the normal position, the second end of the valve member is closed and prevents gases from exiting the drain system through the floor drain and wherein when fluid is inserted into the inner passageway of the valve member at the first end of the valve member, the flexible sidewall uncurls and the inner passageway of the valve member expands adjacent the second end of the valve member such as to allow fluid to exit the valve member at the second end and enter the drain system.

* * * * *